US008276912B2

(12) United States Patent
Yang

(10) Patent No.: US 8,276,912 B2
(45) Date of Patent: Oct. 2, 2012

(54) MEDIUM PATH CONVERTING UNIT, IMAGE FORMING APPARATUS INCLUDING THE SAME AND CONTROL METHOD THEREOF

(75) Inventor: Chun-Seung Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 163 days.

(21) Appl. No.: 12/481,752

(22) Filed: Jun. 10, 2009

(65) Prior Publication Data

US 2010/0044957 A1 Feb. 25, 2010

(30) Foreign Application Priority Data

Aug. 20, 2008 (KR) ..... 10-2008-0081619

(51) Int. Cl.
*B65H 39/10* (2006.01)

(52) U.S. Cl. ..... 271/303; 271/305; 271/298

(58) Field of Classification Search ..... 271/303, 271/305, 298

See application file for complete search history.

(56) References Cited

U.S. PATENT DOCUMENTS

| | | | | |
|---|---|---|---|---|
| 3,556,518 | A * | 1/1971 | Brockmueller et al. | 271/303 |
| 3,866,902 | A * | 2/1975 | Feldkamper | 271/303 |
| 4,352,490 | A * | 10/1982 | Hatakeyama | 271/289 |
| 5,228,681 | A * | 7/1993 | Arnold | 271/303 |
| 5,823,529 | A * | 10/1998 | Mandel et al. | 271/296 |
| 6,547,241 | B2 * | 4/2003 | Yoshida et al. | 271/303 |
| 7,594,659 | B2 * | 9/2009 | Nishimura | 271/303 |
| 2010/0038848 | A1 * | 2/2010 | Tratar et al. | 271/303 |
| 2010/0090397 | A1 * | 4/2010 | Taniguchi | 271/303 |

FOREIGN PATENT DOCUMENTS

JP 04064567 A * 2/1992

* cited by examiner

*Primary Examiner* — Luis A Gonzalez
(74) *Attorney, Agent, or Firm* — Stanzione & Kim, LLP

(57) ABSTRACT

A medium path converting unit to reduce electrical stress, an image forming apparatus including the same and a control method thereof. The medium path converting unit to convert a moving path of a print medium can include a guiding member movable to a first position to guide the print medium to a first path and to a second position to guide the print medium to a second path, an actuator to move the guide member from the first position to the second position, an actuator solenoid to drive the actuator, and a locking unit to lock the actuator to allow the guiding member to maintain the second position.

21 Claims, 8 Drawing Sheets

MEDIUM PATH CONVERTING UNIT, IMAGE FORMING APPARATUS INCLUDING THE SAME AND CONTROL METHOD THEREOF

CROSS-REFERENCE TO RELATED APPLICATIONS

This application claims priority from Korean Patent Application No. 10-2008-0081619, filed on Aug. 20, 2008, in the Korean Intellectual Property Office, the disclosure of which is incorporated herein by reference in its entirety.

BACKGROUND

1. Field of the Inventive Concept

Apparatuses and methods of the present general inventive concept relate to a medium path converting unit, an image forming apparatus including the same and a control method thereof, and more particularly, to a medium path converting unit to reduce electrical stress, an image forming apparatus including the medium path converting unit and a control method thereof.

2. Description of the Related Art

An image forming apparatus forms an image on a print medium and includes a photocopier, a printer, a multi-function device, a facsimile, etc.

While some image forming apparatuses have a single print medium moving path from a paper feeding operation through a printing operation to a discharging operation, other image forming apparatuses which enable printing on both sides of the print medium have another print medium moving path to supply the print medium printed on a single side thereof back to the apparatus.

An image forming apparatus which loads printed print media on a plurality of trays includes a plurality of moving paths to move the print media to the plurality of trays.

A path converting unit is disposed in a merging point of the plurality of moving paths to guide the print medium to one of the plurality of print medium moving paths. The path converting unit includes a solenoid, a plunger which is directly driven by the solenoid, and a guiding member and an elastic member which are driven by the plunger.

In default, the guiding member is disposed to open a first path and to close a second path as long as an external force is not applied by the solenoid. If the path needs to be converted, power is supplied to the solenoid, and the plunger pushes and moves the guiding member to open the second path and close the first path. If the path needs to be converted back to the first path, power supplied to the solenoid is cut off, and the plunger moves back to the original position by the elastic member. As the external force by the plunger is removed, the guiding member also moves back to the original position.

However, the path converting unit continues to supply power to the solenoid to continually maintain the second path as the moving path of the print medium. As a result, the solenoid generates heat and the plunger is magnetized to thereby cause malfunction.

Also, power consumption may increase due to continuous power supply.

SUMMARY

The present general inventive concept can provide a medium path converting unit to reduce occurrence of electrical stress such as heating and magnetization, and can provide an image forming apparatus including the medium path converting unit and a control method thereof.

The present general inventive concept can also provide a medium path converting unit to reduce power consumption.

Additional embodiments of the present general inventive concept will be set forth in part in the description which follows and, in part, will be obvious from the description, or may be learned by practice of the present general inventive concept.

An example embodiment of the present general inventive concept can be achieved by providing a medium path converting unit to convert a moving path of a print medium, the medium path converting unit comprising a guiding member movable to a first position to guide the print medium to a first path and to a second position to guide the print medium to a second path, an actuator to move the guide member from the first position to the second position, an actuator solenoid to drive the actuator, and a locking unit to lock the actuator to maintain the guiding member at the second position.

The medium path converting unit may further comprise an actuator elastic member to elastically bias the actuator to move the guiding member back to the first position.

The locking unit may comprise a stopper movable between a locking position to lock the actuator and an unlocking position to unlock the actuator, and a stopper driver to move the stopper to at least one of the locking position and the unlocking position.

The stopper driver may comprise a stopper elastic member to elastically bias the stopper toward the locking position, and a stopper driving solenoid to move the stopper to the unlocking position.

The locking unit may further comprise a projection provided in one of the actuator and the stopper, and a projection holder provided in the other one of the actuator and the stopper, and coupled with the projection.

At least one of the actuator and the stopper may comprise an accommodation groove to accommodate the projection therein.

At least one of the projection and the projection holder may further comprise an inclination part inclined along a moving direction of the actuator.

The medium path converting unit may further comprise a unit body to support the actuator solenoid, a plunger driven by the actuator solenoid, and an arm having a first end rotatably supported by the unit body and a second end contacting the actuator to move the actuator to the operation position by moving together with the movement of the plunger.

Exemplary embodiments of the present general inventive concept can also be achieved by providing an image forming apparatus comprising a guiding member movable to a first position to guide a print medium to a first discharging path and to a second position to guide the print medium to a second discharging path, an actuator to move the guiding member from the first position to the second position, an actuator solenoid to drive the actuator, a power supply unit to supply power to the actuator solenoid, and a locking unit to lock the actuator to allow the guiding member to maintain the second position.

The locking unit may comprise a stopper movable between a locking position to lock the actuator and an unlocking position to unlock the actuator, and a stopper driver to move the stopper to at least one of the locking position and the unlocking position by receiving power from the power supply unit.

The stopper driver may comprise a stopper elastic member to elastically bias the stopper toward the locking position, and a stopper driving solenoid to move the stopper to the unlocking position by receiving power from the power supply unit.

The image forming apparatus may further comprise a controller to control the power supply unit to supply power to the stopper driver during an unlocking time during which the actuator is unlocked from the stopper if a path conversion from the second discharging path to the first discharging path is requested.

The controller may control the power supply unit to supply power to the actuator solenoid for a predetermined time right before supplying power to the stopper driver.

The image forming apparatus may further comprise a controller to control the power supply unit to supply power to the actuator solenoid during a locking time during which the actuator is locked in the locking unit if a path conversion from the first discharging path to the second discharging path is requested.

The image forming apparatus may further comprise first and second trays to respectively load print media moving along the first and second discharging paths, and a sensor to sense a loading volume of the print media from the first and second trays.

The controller may determine whether there is a path conversion request or not based on whether the loading volume of print media from one of the first tray and the second tray is equal to or greater than a predetermined value according to a sensing result of the sensor.

The first tray may be formed in a main body of the image forming apparatus and the second tray is provided in an optional discharging device detachably attached to the main body of the image forming apparatus.

Exemplary embodiments of the present general inventive concept can also provide a control method of an image forming apparatus, the method comprising supplying power to an actuator solenoid to drive an actuator to move the actuator from a separation position to an operation position if a path conversion from a first discharging path to a second discharging path is requested, moving a guiding member to a first position to allow the actuator to guide a print medium to a first discharging path, locking the actuator to make the guiding member maintain the first position, and cutting off power supplied to the actuator solenoid.

The control method may further comprise supplying power to a locking unit to lock the actuator during an unlocking time and to unlock the actuator if a path conversion from the second discharging path to the first discharging path is requested.

The control method may further comprise supplying power to the actuator solenoid for a predetermined time before supplying power to the locking unit for the unlocking time.

Exemplary embodiments of the present general inventive concept can also be achieved by providing a medium path converting unit to convert a moving path of a print medium, the medium path converting unit including a guiding member having a first position to guide the print medium to a first path and a second position to guide the print medium to a second path, and a power supply unit to supply power to the guiding member to move the guiding member between the first and second positions, and to terminate power to the guiding member when the guiding member is located in the first or second position.

The power supply unit can move the guiding member between the first and second positions based on a loading volume of print media from one of the first and second paths.

The power supply unit can include a solenoid to generate a first magnetic force to move the guiding member from the first position to the second position, and a second magnetic force opposite to the first magnetic force to move the guiding member from the second position to the first position.

Exemplary embodiments of the present general inventive concept can also be achieved by providing a method of controlling a moving path of a print medium, the method including supplying power to a guiding member to move the guiding member between a first position to guide the print medium to a first path and a second position to guide the print medium to a second path, and terminating power to the guiding member when the guiding member is located in the first or second position.

The method may further include sensing a volume of print media from one of the first and second paths, and moving the guiding member between the first and second positions based on the sensed volume.

BRIEF DESCRIPTION OF THE DRAWINGS

Exemplary embodiments of the present general inventive concept will become apparent and more readily appreciated from the following description of the embodiments, taken in conjunction with the accompanying drawings of which.

DETAILED DESCRIPTION OF THE EMBODIMENTS

Figure 1:
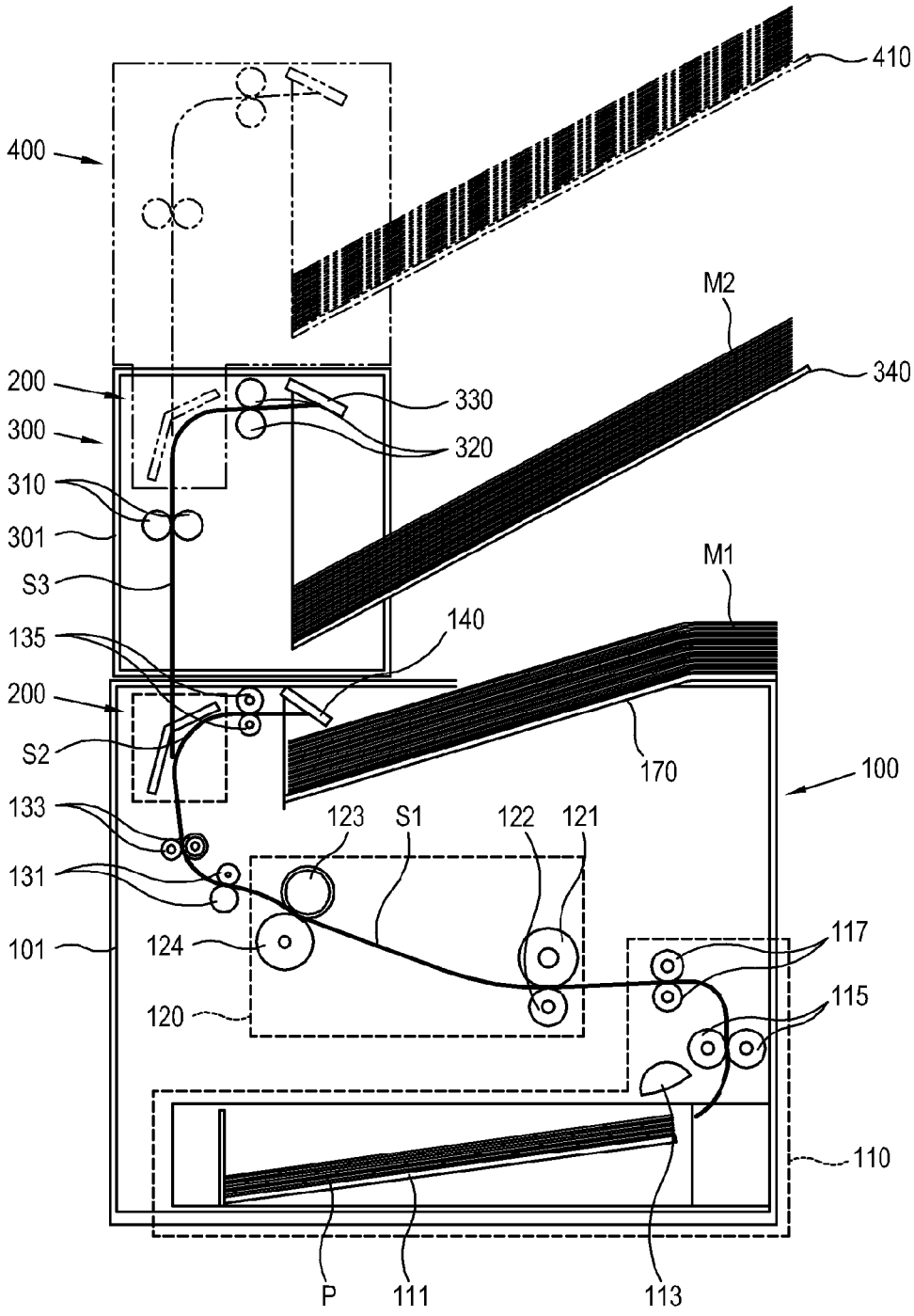
FIG. 1 is a schematic view of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures Hereinafter, a medium path converting unit, an image forming apparatus including the same and a control method thereof according to example embodiments of the present general inventive concept will be described in detail with reference to drawings.

As illustrated in FIG. 1, an image forming apparatus 100 according to an example embodiment of the present general inventive concept can include a paper feeding unit 110, an image forming unit 120 and a medium path converting unit 200.

The paper feeding unit 110 can include a knock-up plate 111 having a print medium P thereon to be printed, a pickup roller 113 to pick up the print medium P from the knock-up plate 111 and a plurality of moving rollers 115 and 117 to move the picked-up print medium P to the image forming unit 120.

The image forming unit 120 can form an image on the print medium P fed by the paper feeding unit 110. The image forming unit 120 can include an image carrier 121 to form an electrostatic latent image thereon by an exposing unit (not illustrated), a developing roller (not illustrated) to develop the image carrier 121 with a toner, a transfer roller 122 to transfer the toner from the image carrier 121 to the print medium P, and fusing rollers 123 and 124 to fuse the toner transferred to the print medium P by heat and pressure.

The image forming unit 120 can employ an electrophotographic-type process. The image forming unit 120 may also employ at least one of an inkjet-type process to form an image on the print medium P with ink, and a thermal transfer-type process to form an image on a special print medium P with a thermal printing head (TPH).

Print media M1 and M2 to be printed by the image forming unit 120 can be moved to a first tray 170 or a second tray 340 along a plurality of discharging rollers 131 and 133. Here, the second tray 340 can be provided in an optional discharging device 300 (to be described later). It is possible that an additional second tray may be provided in a device main body 101 of the image forming apparatus 100.

After being fed from the paper feeding unit 110 along a common moving path S1 in FIG. 1 and passing the image forming unit 120, the printed print medium P can be discharged through a discharging path. Here, the discharging path can be selected by the medium path converting unit 200 between a first moving path S2 to guide the print medium P to the first tray 170 and a second moving path S3 to guide the print medium P to the second tray 340.

Meanwhile, the image forming apparatus 100 may further include the optional discharging device 300 which can be detachably attached to the device main body 101.

As illustrated in FIG. 1, the optional discharging device 300 can be provided in an upper part of the device main body 101, and can include a second moving path S3 to communicate with the moving path S1 formed in the device main body 101.

The optional discharging device 300 can include a plurality of discharging rollers 310 and 320 which can be disposed along the second moving path S3, and the second tray 340. The optional discharging device 300 may further include a sensor 330 to sense a loading volume of the print medium M2 loaded in the second tray 340.

The sensor 330 may include a light emitter (not illustrated), a light receiver (not illustrated), and a lever to block or transmit light between the light emitter and the light receiver. The lever can be disposed such that a first end thereof contacts an upper part of the print medium M2 and a second end thereof is disposed to block the light from the light emitter to the light receiver. The lever can be disposed to rotate with respect to a hinge shaft between the first and second ends. Accordingly, if the loading volume of the print medium N2 is equal to or greater than a predetermined value, the second end of the lever can rotate and light can be transmitted from the light emitter to the light receiver. That is, depending on whether the light receiver receives light, it may be determined whether the loading volume of the print medium M2 is equal to or greater than a predetermined value. Those skilled in the art will appreciate that although an example embodiment of the present general inventive concept can include the sensor 330 as described above, the present general inventive concept is not limited thereto, and other known or later developed sensors may be used to sense the loading volume of the print medium without departing from the principles and spirit of the present general inventive concept.

In the present example embodiment, a sensor 140 which is the same as the sensor 330 may be provided in the first tray 170 to sense the loading volume of the print medium.

As illustrated in FIG. 1, although the medium path converting unit 200 can be installed in the device main body 101, the present general inventive concept is not limited thereto. For example, the medium path converting unit 200 may also be installed in the optional discharging device 300 without departing from the principles and spirit of the present general inventive concept.

If the medium path converting unit 200 is installed in the optional discharging device 300, a device main body 301 of the optional discharging device 300 may extend to a point from which the first moving path S2 and the second moving path S3 are branched. In this case, a print medium may be loaded in another tray 410 by providing another optional discharging device 400 having the same shape as the optional discharging device 300 on the upper part of the optional discharging device 300. In this manner, the image forming apparatus 100 may extend so as to have three or more trays 170, 340 and 410.

Figure 2:
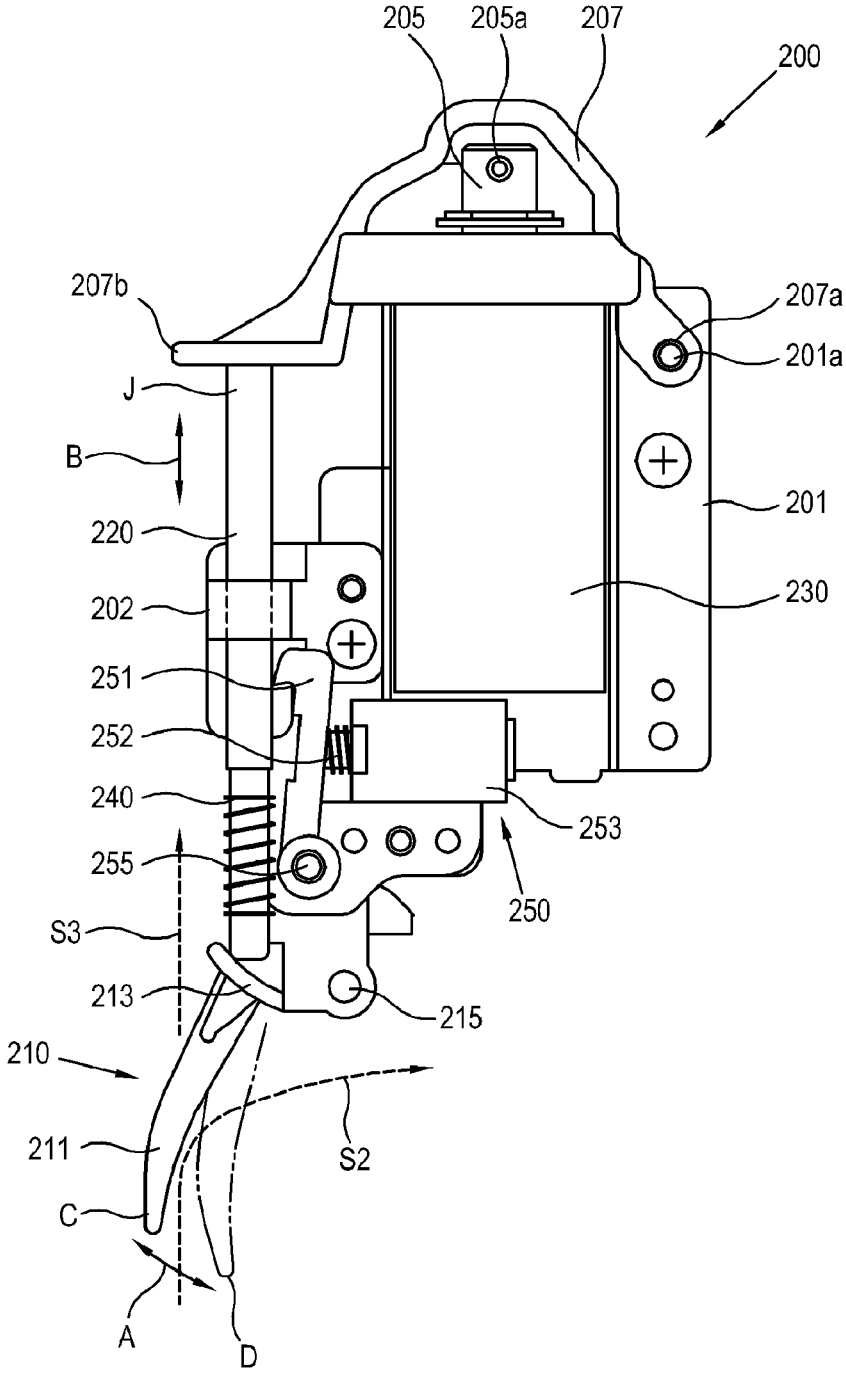
FIG. 2 is an enlarged view of a medium path converting unit of the image forming apparatus in FIG. 1.

As illustrated in FIG. 2, the medium path converting unit 200 can include a guiding unit 210 which can be movable to guide the print medium to either the first moving path S2 or the second moving path S3, an actuator 220 to change a position of the guiding unit 210, an actuator driving solenoid 230 to drive the actuator 220, and a locking unit 250 to lock the actuator 220 to maintain the guiding unit 210 at the converted path.

The guiding unit 210 can include a guiding member 211 to move the print media M1 and M2 printed by the image forming unit 120 to a first position C to guide the print media M1 and M2 to the first moving path S2, and a second position D to guide the print media M1 and M2 to the second moving path S3, an external force receiver 213 to receive an external force from the actuator 220, and a hinge shaft 215.

The guiding member 211 can rotate in a clockwise and counterclockwise direction A between the first and second positions C and D with respect to the hinge shaft 215.

If the external force is not applied by the actuator 220, i.e., as illustrated in FIG. 2, the guiding member 211 can be elastically biased by the elastic member to be disposed in the first position C. The elastic member may include a torsion coil spring which can be provided in the hinge shaft 215.

If the external force is applied to the external force receiver 213 by the actuator 220, the guiding member 211 can move to the second position D. If the external force is not applied, the guiding member 211 can be restored to the first position by the elastic member.

As illustrated in FIGS. 2 to 5, the actuator 220 may rectilinearly reciprocate in upward and downward directions B. More specifically, as illustrated in FIG. 2, the actuator 220 may reciprocate between a separation position J when the external force is not applied to the external force receiver 213 and an operation position K (see FIG. 5) where the actuator 220 can operate to apply the external force to the external force receiver 213.

If the actuator driving solenoid 230 (which will be described later) receives power, the actuator 220 can move from the separation position J to the operation position K by a driving force of the actuator driving solenoid 230. As the external force is applied to the external force receiver 213 of the guiding unit 210, the guiding member 211 can move from the first position C to the second position D to close the first moving path S2 and to open the second moving path S3.

The actuator 220 may be inserted into an actuator supporting frame 202 to rectilinearly reciprocate by the actuator supporting frame 202.

Figure 3:
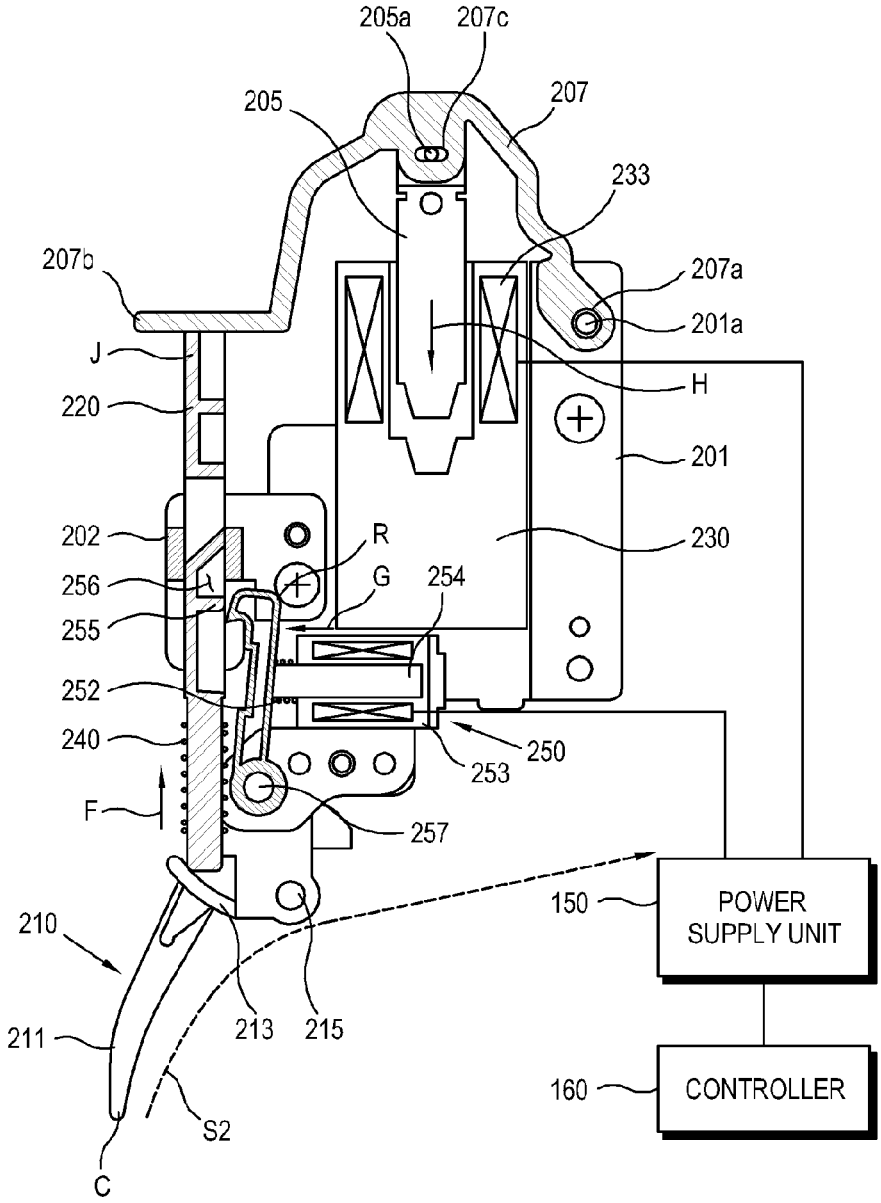
FIG. 3 is a schematic sectional view of the medium path converting unit in FIG. 2 in the state that a guiding unit guides a print medium to a first moving path.

As illustrated in FIG. 3, the actuator driving solenoid 230 can include a coil 233 to generate a magnetic force H. If power is supplied to the coil 233, a plunger 205 (which will be described later) can move downwards by the magnetic force H. Then, an arm 207, which can be connected with the plunger 205, can also move downward to press the actuator 220 contacting the plunger 205. The actuator 220 can then move to the operation position K.

As illustrated in FIG. 3, a first end of the arm 207 can be provided to rotate with respect to a hinge shaft 201*a* of a unit body 201 supporting the solenoid 230. A hinge shaft opening 207*a* can be provided in the first end of the arm 207 to insert the hinge shaft 201*a* thereinto. The arm 207 can include an insertion groove 207*c* to extend in a transverse direction to insert a plunge pin 205*a* of the plunger 205 thereinto while a second end of the arm 207 contacts the actuator 220.

The plunger 205 and the arm 207 can be used to transmit the driving force from the actuator driving solenoid 230 to the actuator 220, although other means may be used without departing from the principles and spirit of the present general inventive concept. For example, it is possible that the plunger 205 and the arm 207 may be omitted and the actuator driving solenoid 230 may directly drive the actuator 220. In this case, the actuator 220 may include a magnetic material like the plunger 205, and may be directly driven by the magnetic force F of the solenoid 230.

The locking unit 250 can mechanically lock the actuator 220 to maintain the actuator 220 at the operation position K. If a path conversion from the first moving path S2 to the second moving path S3 is provided, power may be supplied to the actuator driving solenoid 230 only during a locking time during which the actuator 220 is locked in the locking unit 250 so that the actuator 220 remains in the operation position K. As the actuator 220 can remain in the operation position K, the guiding unit 210 can also remain in the second position D. As a result, the first moving path S2 can be closed while the second moving path S3 remains open.

Since the power can be supplied to the actuator driving solenoid 230 only during the locking time and not after the locking time, heat and magnetization of the plunger 205 due to the continuous power supply may be reduced.

As illustrated in FIGS. 3 to 6, the locking unit 250 can include a stopper 251 which is movable between a locking position N locking the actuator 220 and an unlocking position R to unlock the actuator 220, a stopper elastic member 252 to elastically bias the stopper 251 toward the locking position N, and a stopper driving solenoid 254 to move the stopper 251 toward the unlocking position R.

The stopper 251 can be provided to rotate between the locking position N and the unlocking position R with respect to the hinge shaft 257. It is also possible that the stopper 251 may be provided to slide between the locking position N and the unlocking position R.

The plunger 254 can transmit a driving force V of the stopper driving solenoid 254 to the stopper 251 to be moved to the unlocking position R.

As illustrated in FIG. 3, an elastic force G of the stopper elastic member 252 can be applied to elastically bias the stopper 251 to the locking position N. The stopper elastic member 252 may be provided in an external circumference of the plunger 254 between the stopper 251 and the stopper driving solenoid 254.

The locking unit 250 may include a projection 251*a* which can be provided in the stopper 251 and a projection holder 255 which can be provided in the actuator 220.

Figure 4:
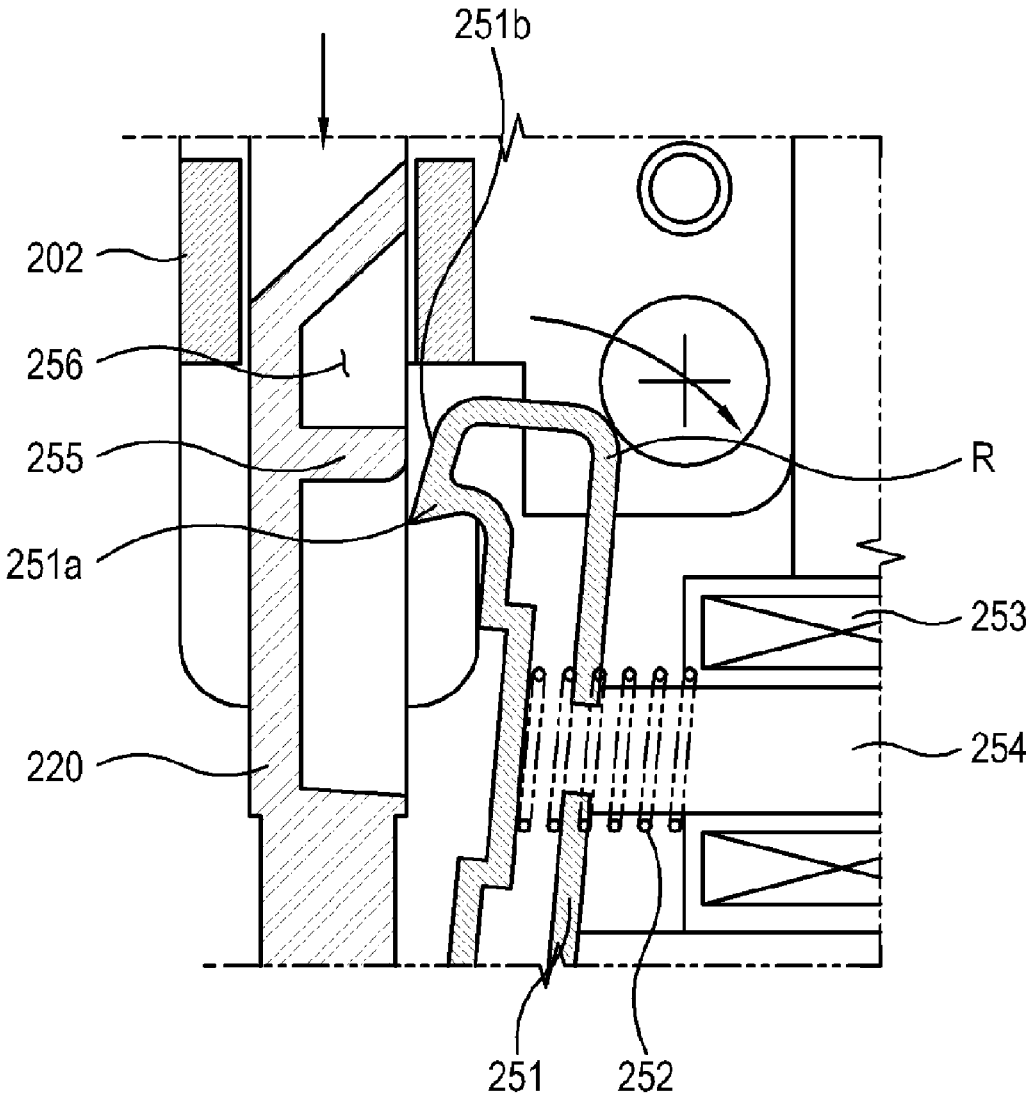
FIG. 4 is an enlarged sectional view of main parts in FIG. 3.

As illustrated in FIG. 4, if the actuator 220 moves from the separation position J down to the operation position K, the projection holder 255 contacting the projection 251*a* can push the projection 251*a*. Accordingly, the stopper 251 can rotate clockwise. If the actuator 220 moves further downwards, a lower surface of the projection 251*a* can contact an upper surface of the projection holder 255 to lock the actuator 220 by the stopper 251. Here, the projection 251*a* may include an inclination part 251*b* which can be inclined to rotate the stopper 251 according to the downward movement of the actuator 220.

The actuator 220 may further include an accommodation groove 256 to accommodate the projection 251*a* therein.

The projection 251*a*, the projection holder 255 and the accommodation groove 256 may otherwise be provided in the actuator 220 and the stopper 251, respectively. The shapes of the projection 251*a* and the projection holder 255 may vary. For example, the projection holder 255 may also include a projection which protrudes from an external surface of the actuator 220.

If the print medium moving path is changed from the second moving path S3 back to the first moving path S2, the locking unit 250 can unlock the actuator 220 to be restored to the separation position J. The guiding member 211 of the guiding unit 210 can be restored to the first position C to thereby open the first moving path S2 and to close the second moving path S3.

The driving force which restores the actuator 220 to the separation position J may be generated from the elastic force F of the actuator elastic member 240. More specifically, the actuator elastic member 240 can elastically bias the actuator 220 from the operation position K to the separation position J. The actuator elastic member 240 may include a compressed coil spring to surround an external circumference of the actuator 220. Alternatively, the actuator elastic member 240 may include various shapes and materials to perform the same or similar function.

The driving force F which restores the actuator 220 to the separation position J may also be obtained from the actuator driving solenoid 230 other than from the actuator elastic member 240. More specifically, as illustrated in FIG. 3, power which has an opposite polarity to that supplied to the solenoid 230 to generate the magnetic force H in a direction pressing the actuator 220 downwards can be supplied to the solenoid 230 so that a magnetic force which has an opposite direction to the magnetic force H can be generated. Then, the actuator 220 may move to the separation position J.

Reconversion to the first moving path S2 will now be described. If power is supplied to the stopper driving solenoid 254, the stopper 251 can move from a position in FIG. 6 to a position in FIG. 4. That is, the stopper 251 can move from the locking position N to the unlocking position R, and the actuator 220 can be restored to the separation position J by the elastic force F of the elastic member 240 to thereby restore the guiding member 211 to the first position C.

The power can be supplied to the stopper driving solenoid 254 only during the time during which the stopper 251 moves to the unlocking position R, i.e., during the unlocking time during which the actuator 220 is unlocked from the stopper 251. Accordingly, after the unlocking time elapses, power supplied to the stopper driving solenoid 254 can be cut off.

Since the path can be converted by supplying power to the stopper driving solenoid 254 during the short unlocking time, heat of the stopper driving solenoid 254 and the magnetization of the plunger 205 may be minimized.

Figure 5:
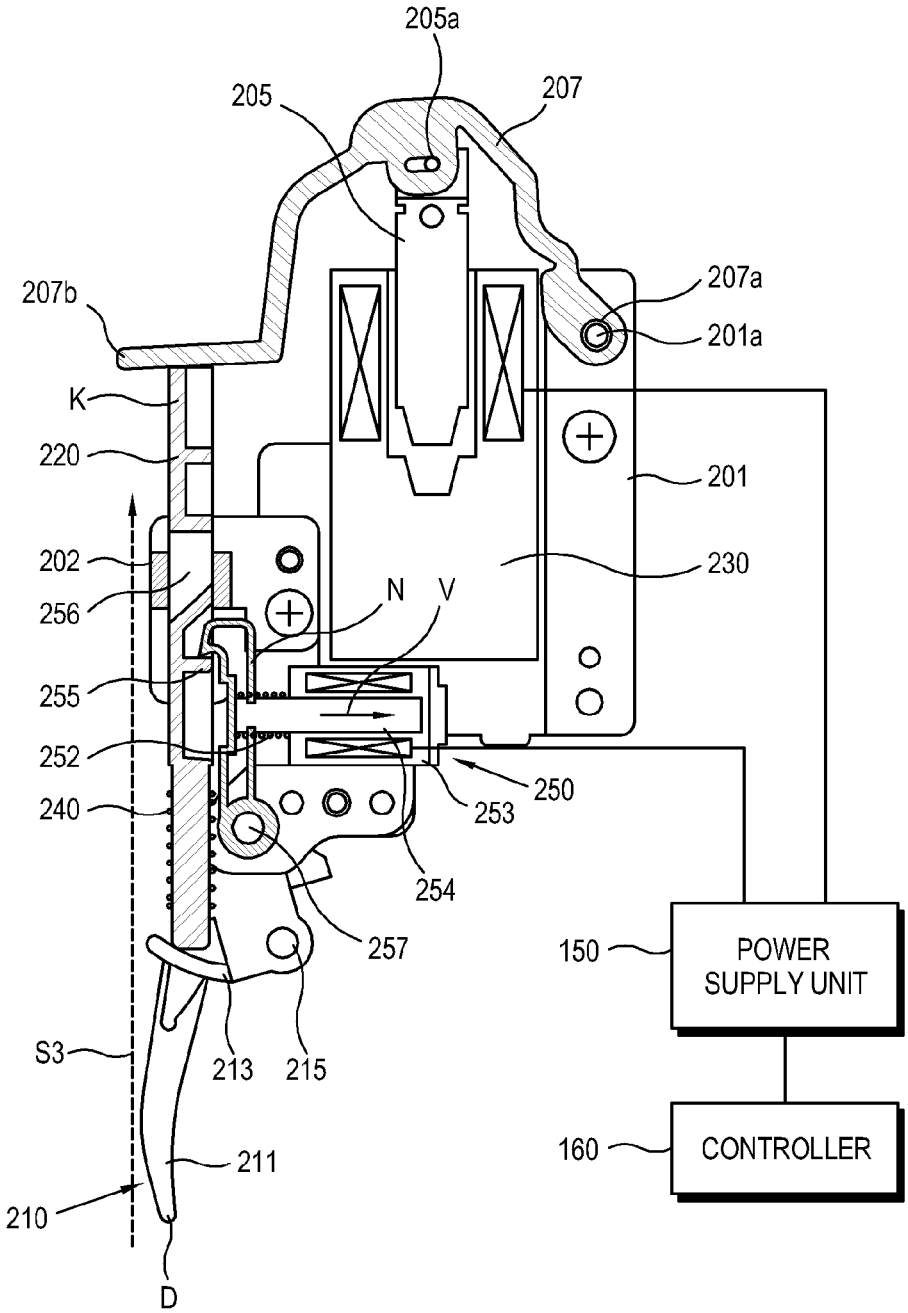
FIG. 5 is a schematic sectional view of the medium path converting unit in FIG. 2 in the state that the guiding unit guides a print medium to a second moving path.

As illustrated in FIGS. 3 and 5, the image forming apparatus 100 can further include a power supply unit 150 to supply power to the actuator driving solenoid 230 and the stopper driving solenoid 254, and a controller 160 to control the power supply unit 150 if a moving path conversion of the print medium is requested.

Figure 7:
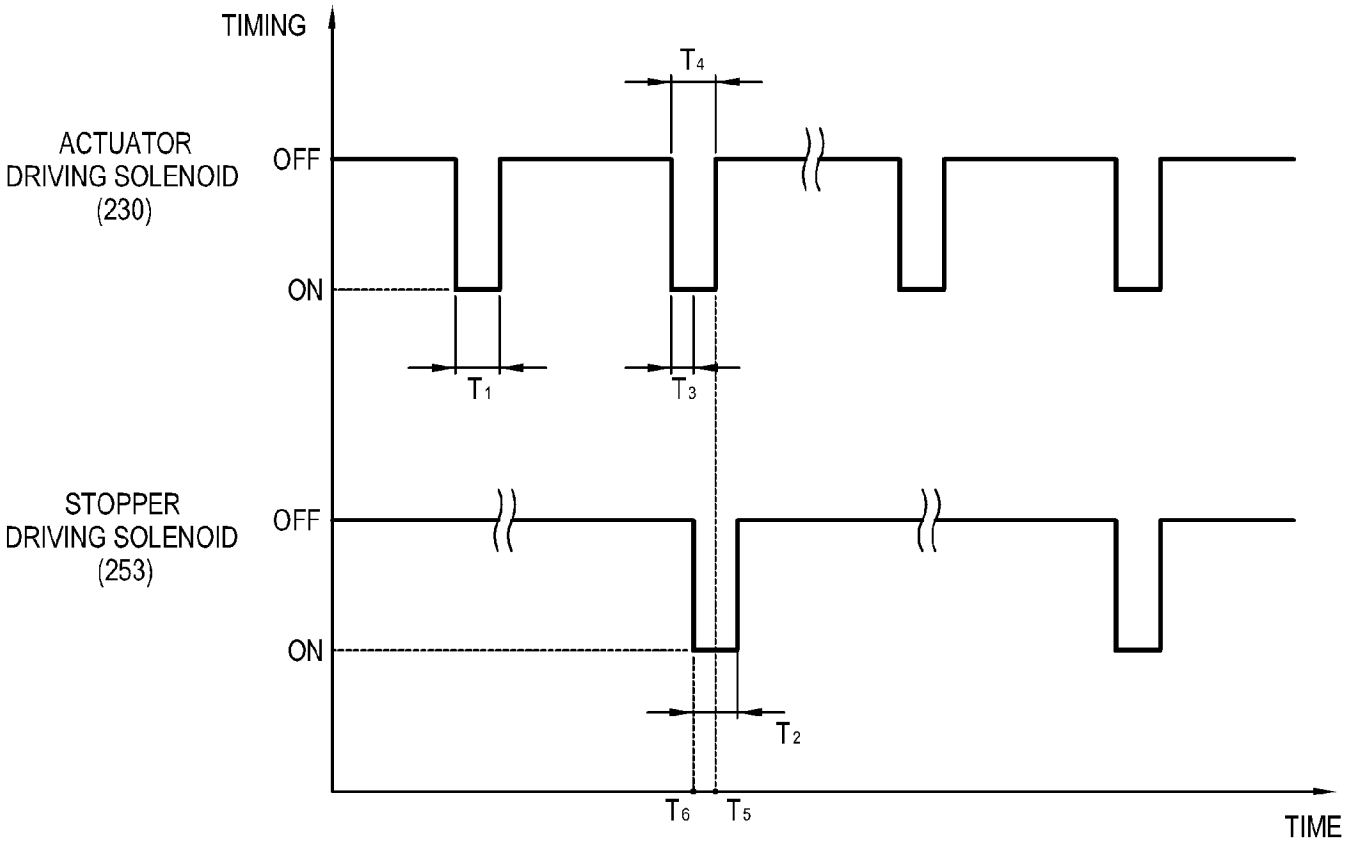
FIG. 7 illustrates an operation timing of a solenoid of the medium path converting unit in FIG. 2.
Figure 8:
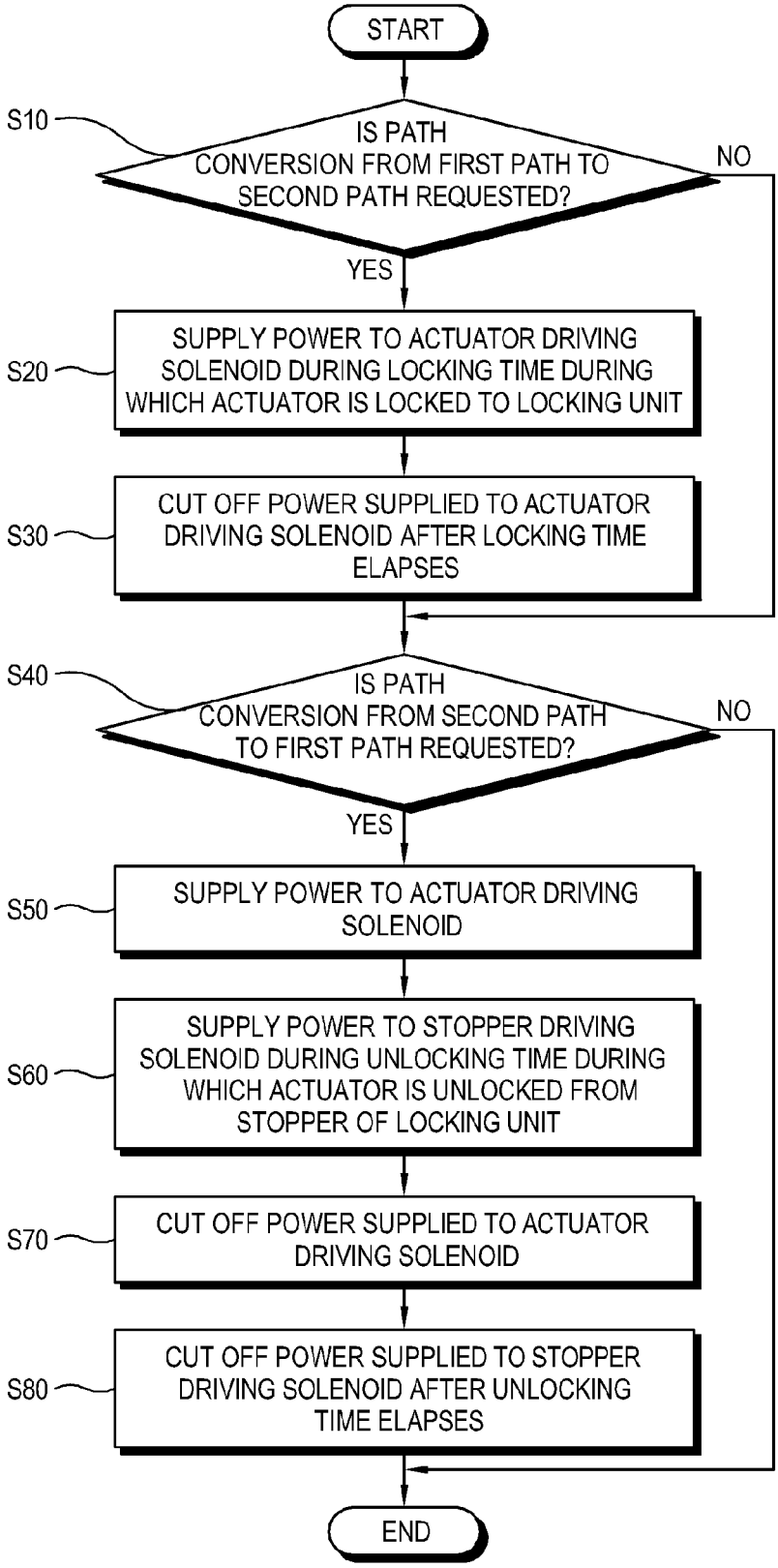
FIG. 8 is a flowchart of a control method of the image forming apparatus according to an embodiment of the present general inventive concept.

If a moving path conversion from the first moving path S2 to the second moving path S3 is requested, the controller 160 can control the power supply unit 150 to supply power to the actuator driving solenoid 230 during the locking time T1 during which the actuator 220 is locked in the stopper 251 of the locking unit 250 as illustrated in FIG. 7. After the locking time T1 elapses, the controller 160 can control the power supply unit 150 not to supply power to the actuator driving solenoid 230.

Here, the locking time T1 may be determined by experiment or experience.

Thus, not only can power consumption be reduced, but also electrical stress such as heat of the actuator driving solenoid 230 and magnetization of the plunger 205 may be minimized.

If a moving path conversion from the second moving path S3 to the first moving path S2 is requested, the controller 160 can control the power supply unit 150 to supply power to the stopper driving solenoid 253 during the unlocking time T2 during which the actuator 220 is unlocked from the stopper 251 as illustrated in FIG. 7.

After the unlocking time T2 elapses, the controller 160 can control the power supply unit 150 to not supply power to the stopper driving solenoid 254. The power supply may be controlled by turning on or off the power supply unit 150.

Thus, not only can power consumption be reduced, but also electrical stress such as heat of the actuator driving solenoid 230 and magnetization of the plunger 205 may be minimized.

Figure 6:
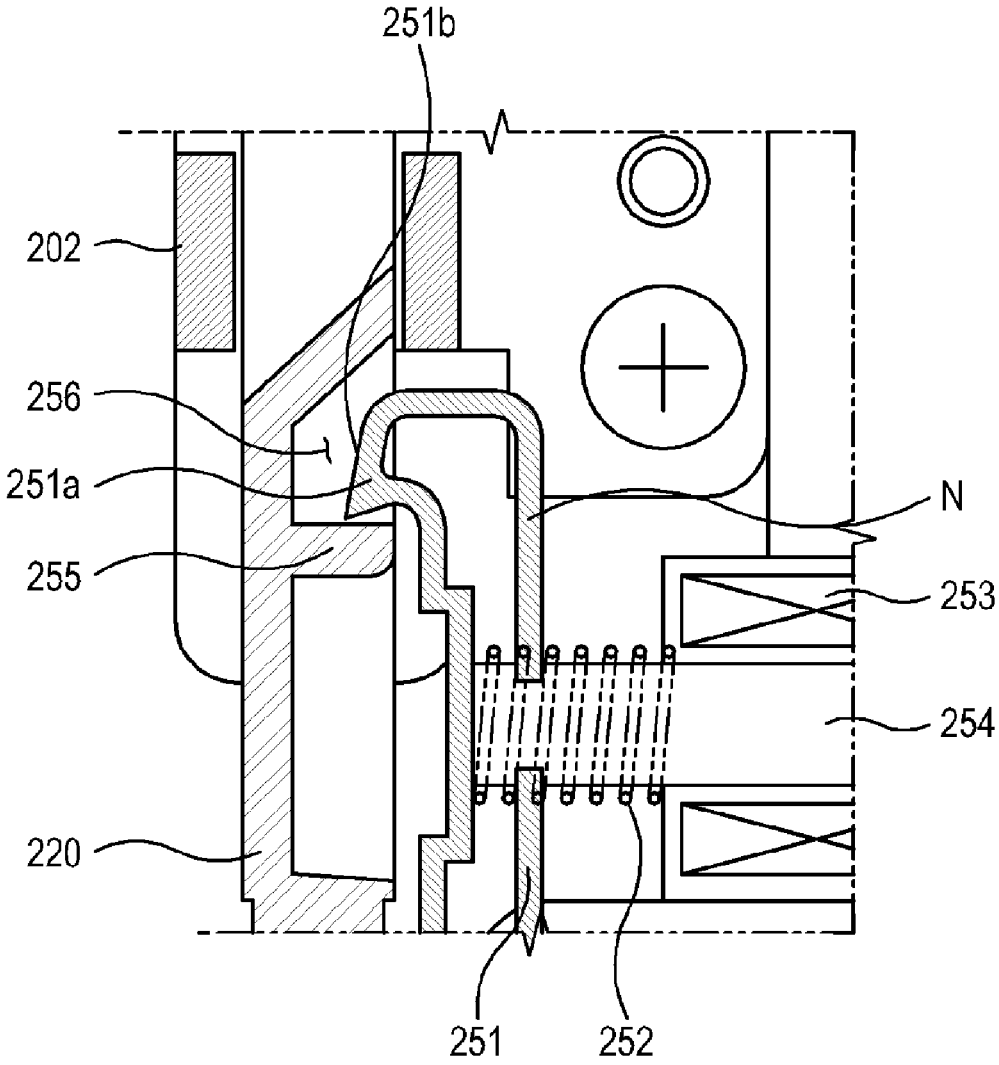
FIG. 6 is an enlarged sectional view of main parts in FIG. 5.

As illustrated in FIG. 6, a large capacity stopper driving solenoid 254 may be provided to move the stopper 251 to the unlocking position R as a friction force between the projection 251*a* of the stopper 251 and the projection holder 255 of the actuator 220 is large. That is, the friction force may be large as the actuator 220 is elastically biased to the separation position J by the actuator elastic member 240.

To reduce the friction force, the projection 251*a* and the projection holder 255 may be spaced from each other by pressing the actuator 220 downwards before moving the stopper 251 to the unlocking position R. With a low capacity stopper driving solenoid 253, manufacturing costs may be reduced.

Referring to the operation timing of the two solenoids 230 and 253 of FIG. 7, the controller 160 may control the power supply unit 150 to supply power to the actuator driving solenoid 230 during a predetermined friction force-reducing time T3 before supplying the power to the stopper driving solenoid 254 to have the projection 251*a* and the projection holder 255 spaced from each other to thereby reduce the friction force.

It is possible that power may be supplied to the actuator driving solenoid 230 during a time T4 longer than the friction force-reducing time T3. In this case, the power supply time T4 of the actuator driving solenoid 230 may overlap the power supply time T2 of the stopper driving solenoid 254.

Hereinafter, a control method of the image forming apparatus 100 according to an embodiment of the present general inventive concept will be described with reference to FIGS. 2, 3, 5 and 8.

At operation S10, it can be determined whether a path conversion from the first moving path S2 to the second moving path S3 is requested. It may be determined that the path conversion to the second moving path S3 can be requested to discharge the print medium to the second tray 340 instead of the first tray 170 when the loading volume of the print medium in the first tray 170 is equal to or greater than the predetermined value, and the loading volume of the print medium in the second tray 340 is less than the predetermined value according to the sensing result of the sensors 140 and 330 in FIG. 1. The request for the path conversion may be inputted by a user if necessary.

If it is determined that the path conversion is requested (YES in the operation S10), power can be supplied to the actuator driving solenoid 230 during the locking time T1 (refer to FIG. 7) during which the actuator 220 is locked in the locking unit 250, at operation S20.

After the locking time T1 elapses, power supplied to the actuator driving solenoid 230 can be cut off, at operation S30.

If it is determined that the path conversion is not requested (NO in the operation S10), it can be determined whether a path conversion from the second moving path S3 to the first moving path S2 is requested, at operation S10. It may be determined that the path conversion to the second moving path S2 can be requested to discharge the print medium to the first tray 170 instead of the second tray 340 when the loading volume of the print medium in the second tray 340 is equal to or greater than the predetermined value, and the loading volume of the print medium in the first tray 170 is less than the predetermined value according to the sensing result of the sensors 140 and 330 in FIG. 1. The request for the path conversion may be inputted by a user if necessary.

If it is determined that the path conversion is requested (YES in the operation S40), power can be supplied to the actuator driving solenoid 230, at operation S50. Thus, as described above, the projection 251*a* of the stopper 251 and the projection holder 255 of the actuator 220 can be spaced from each other to reduce the friction force therebetween.

At operation S60, power can be supplied to the stopper driving solenoid 254 during the unlocking time T2 during which the actuator 220 is unlocked from the stopper 251 of the locking unit 250.

Power which is supplied to the actuator driving solenoid 230 can then be cut off, at operation S70. Here, as illustrated in FIG. 7, the power supply cutting time T5 of the actuator driving solenoid 230 may be within the unlocking time T2 or coincide with the power supply time T6 of the stopper driving solenoid 254 depending on cases. As described above, the operations S50 and S70 may be omitted since they can be performed to reduce the friction force and move the stopper 251 to the unlocking position R with less force.

Then, after the unlocking time T2 elapses, power supplied to the stopper driving solenoid 254 can be cut off, at operation S80.

Even if power is supplied to the plurality of solenoids 230 and 253 only for short time, the medium path converting unit 200 may operate and electric stress thereto may be minimized. Accordingly, not only malfunction of the medium path converting unit 200 may be prevented but also power consumption may be reduced.

The medium path converting unit 200 can convert the discharging path of the printed print medium as an example of the present general inventive concept, but the present general inventive concept is not limited thereto. For example, the medium path converting unit 200 according to the present general inventive concept may also be used to change the path of a print medium.

As described above, the medium path converting unit, the image forming apparatus including the same and the control method thereof which have the foregoing configuration can be used to reduce electrical stress such as heat of the solenoid or magnetization of the plunger, since power supply time of the solenoid can be minimized.

Power consumption of the image forming apparatus may also be reduced.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A medium path converting unit to convert a moving path of a print medium, the medium path converting unit comprising:

a guiding member movable to a first position to guide the print medium to a first path and to a second position to guide the print medium to a second path;

an actuator to move along a linear path to move the guiding member from the first position to the second position;

an actuator solenoid to drive the actuator; and a locking unit to lock the actuator to maintain the guiding member at the second position, the locking unit including a stopper movable between a locking position to lock the actuator and an unlocking position to unlock the actuator and a stopper driver to move the stopper to at least one of the locking position and the unlocking position.

2. The medium path converting unit of claim 1, further comprising an actuator elastic member to elastically bias the actuator to move the guiding member back to the first position.

3. The medium path converting unit of claim 1, wherein the stopper driver comprises a stopper elastic member to elastically bias the stopper toward the locking position; and a stopper driving solenoid to move the stopper to the unlocking position.

4. The medium path converting unit of claim 1, wherein the locking unit further comprises a projection provided in one of the actuator and the stopper; and a projection holder, provided in the other one of the actuator and the stopper, and coupled with the projection.

5. The medium path converting unit of claim 4, wherein at least one of the actuator and the stopper comprises an accommodation groove to accommodate the projection therein.

6. The medium path converting unit of claim 4, wherein at least one of the projection and the projection holder further comprises an inclination part inclined alona a moving direction of the actuator.

7. The medium path converting unit of claim 1, further comprising:

a unit body to support the actuator solenoid;

a plunger driven by the actuator solenoid; and an arm having a first end rotatably supported by the unit body and a second end contacting the actuator to move the actuator to the operation position by moving together with the movement of the plunger.

8. An image forming apparatus comprising:

a guiding member movable to a first position to guide a print medium to a first discharging path and to a second position to guide the print medium to a second discharging path;

an actuator to move along a linear path to move the guiding member from the first position to the second position;

an actuator solenoid to drive the actuator;

a power supply unit to supply power to the actuator solenoid; and a locking unit to lock the actuator to allow the guiding member to maintain the second position, the locking unit including a stopper movable between a locking position in which a projection provided on one of the actuator and the stopper is coupled with a projection holder provided on the other of the actuator and the stopper to lock the actuator and an unlocking position to unlock the actuator, and a stopper driver to move the stopper to at least one of the looking position and the unlocking position by receiving power from the power supply unit.

9. The image forming apparatus of claim 8, wherein the stopper driver comprises a stopper elastic member to elastically bias the stopper toward the locking position; and a stopper driving solenoid to move the stopper to the unlocking position by receiving power from the power supply unit.

10. The image forming apparatus of claim 8, further comprising a controller to control the power supply unit to supply power to the stopper driver during an unlocking time during which the actuator is unlocked from the stopper if a path conversion from the second discharging path to the first discharging path is requested.

11. The image forming apparatus of claim 10, wherein the controller controls the power supply unit to supply power to the actuator solenoid for a predetermined time before supplying power to the stopper driver.

12. The image forming apparatus of claim 8, further comprising a controller to control the power supply unit to supply power to the actuator solenoid during a locking time during which the actuator is locked in the locking unit if a path conversion from the first discharging path to the second discharging path is requested.

13. The image forming apparatus of claim 8, further comprising first and second trays to respectively load print media moving along the first and second discharging paths; and a sensor to sense a loading volume of the print media from the first and second trays.

14. The image forming apparatus of claim 13, further comprising:

a controller to determine whether there is a path conversion request based on whether the loading volume of print media from one of the first tray and the second tray is equal to or greater than a predetermined value according to a sensing result of the sensor.

15. The image forming apparatus of claim 13, wherein the first tray is formed in a main body of the image forming apparatus and the second tray is provided in an optional discharging device detachably attached to the main body of the image forming apparatus.

16. A control method of an image forming apparatus, the control method comprising:

supplying power to an actuator solenoid to drive an actuator to move the actuator from a separation position to an operation position if a path conversion from a first discharging path to a second discharging path is requested;

moving a guiding member to a first position to allow the actuator to guide a print medium to the first discharging path;

locking the actuator to make the guiding member maintain the first position; and cutting off power supplied to the actuator solenoid after locking the actuator; and supplying power to a locking unit to unlock the actuator during an unlocking time if a path conversion from the second discharging path to the first discharging path is requested.

17. The control method of claim 16, further comprising supplying power to the actuator solenoid for a predetermined time before supplying power to the locking unit for the unlocking time.

18. A medium path converting unit to convert a moving path of a print medium, the medium path converting unit comprising:

a guiding member having a first position to guide the print medium to a first path and a second position to guide the print medium to a second path;

an actuator to move along a linear path to move the guiding member from the first position to the second position;

a power supply unit to supply power to the actuator to move the guiding member between the first and second positions, and to terminate power to the actuator when the guiding member is located in the first or second position; and a locking unit to lock the actuator to allow the guiding member to maintain the second position, the locking unit including a stopper movable between a locking position in which a projection provided on one of the actuator and the stopper is coupled with a projection holder provided on the other of the actuator and the stopper to lock the actuator and an unlocking position to unlock the actuator, and a stopper driver to move the stopper to at least one of the locking position and the unlocking position.

19. The medium path converting unit of claim 18, wherein the power supply unit moves the guiding member between the first and second positions based on a loading volume of print media from one of the first and second paths.

20. A medium path converting unit to convert a moving path of a print medium, the medium path converting unit comprising:

a guiding member movable to a first position to guide the print medium to a first path and to a second position to guide the print medium to a second path;

an actuator to move along a linear path to move the guiding member from the first position to the second position;

an actuator solenoid to drive the actuator; and a locking unit to lock the actuator to maintain the guiding member at the second position, wherein the locking unit comprises:

a stopper movable between a locking position in which a projection provided on one of the actuator and the stopper is coupled with a projection holder provided on the other of the actuator and the stopper to lock the actuator and an unlocking position to unlock the actuator; and a stopper driver to move the stopper to at least one of the locking position and the unlocking position, wherein the stopper driver comprises:

a stopper elastic member to elastically bias the stopper toward the locking position; and a stopper driving solenoid to move the stopper to the unlocking position.

21. A medium path converting unit to convert a moving path of a print medium, the medium path converting unit comprising:

a guiding member movable to a first position to guide the print medium to a first path and to a second position to guide the print medium to a second path;

an actuator to move the guiding member from the first position to the second position;

an actuator solenoid to drive the actuator;

a locking unit to lock the actuator to maintain the guiding member at the second position;

a unit body to support the actuator solenoid;

a plunger driven by the actuator solenoid; and an arm having a first end rotatably supported by the unit body and a second end contacting the actuator to move the actuator to the operation position by moving together with the movement of the plunger.

* * * * *